US008119735B2

(12) United States Patent
Hebert et al.

(10) Patent No.: US 8,119,735 B2
(45) Date of Patent: Feb. 21, 2012

(54) GOLF BALL WITH COVER HAVING A PEARLESCENT EFFECT

(75) Inventors: Edmund A. Hebert, Mattapoisett, MA (US); Murali Rajagopalan, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 418 days.

(21) Appl. No.: 12/359,688

(22) Filed: Jan. 26, 2009

(65) Prior Publication Data

US 2010/0190582 A1 Jul. 29, 2010

(51) Int. Cl.
*A63B 37/12* (2006.01)
*C08L 33/02* (2006.01)
*C08L 25/10* (2006.01)

(52) U.S. Cl. ..... 525/67; 525/74; 525/201; 525/207; 525/208; 525/217; 525/221; 473/373; 473/378; 473/385

(58) Field of Classification Search ..... None
See application file for complete search history.

(56) References Cited

U.S. PATENT DOCUMENTS

| | | | | |
|---|---|---|---|---|
| 3,384,612 | A * | 5/1968 | Brandt et al. | 428/407 |
| 5,427,378 | A | 6/1995 | Murphy | |
| 6,012,991 | A * | 1/2000 | Kim et al. | 473/374 |
| 6,034,182 | A * | 3/2000 | Kashiwagi et al. | 525/240 |
| 6,187,864 | B1 * | 2/2001 | Rajagopalan | 525/183 |
| 6,274,669 | B1 * | 8/2001 | Rajagopalan | 525/64 |
| 6,949,595 | B2 | 9/2005 | Morgan et al. | |
| 7,004,856 | B2 | 2/2006 | Sullivan et al. | |
| 7,300,364 | B2 | 11/2007 | Boehm et al. | |
| 2001/0018375 | A1 | 8/2001 | Hayashi et al. | |
| 2001/0019971 | A1 | 9/2001 | Hayashi et al. | |
| 2001/0020069 | A1 * | 9/2001 | Takesue et al. | 525/201 |
| 2004/0176188 | A1 | 9/2004 | Morgan et al. | |
| 2005/0197211 | A1 * | 9/2005 | Sullivan et al. | 473/371 |
| 2006/0293121 | A1 * | 12/2006 | Egashira et al. | 473/370 |
| 2007/0149323 | A1 | 6/2007 | Morgan et al. | |
| 2008/0015053 | A1 | 1/2008 | Watanabe | |

OTHER PUBLICATIONS

Designer Data Sheet for polyoxymethylene; pp. 1-2; no date.*
Thain, Science and Golf IV; 2002; pp. 319-327.*

* cited by examiner

*Primary Examiner* — David Buttner
(74) *Attorney, Agent, or Firm* — Kristin D. Wheeler

(57) ABSTRACT

A golf ball having a cover having a pearlescent effect is disclosed. The cover comprises a first thermoplastic and a second thermoplastic having an index of refraction that differs from an index of refraction of the first thermoplastic by at least about 0.5 percent. The cover further comprises a compatibilizer.

29 Claims, No Drawings

GOLF BALL WITH COVER HAVING A PEARLESCENT EFFECT

FIELD OF THE INVENTION

The present invention relates to golf balls, and more particularly, to golf balls having covers comprising blends of thermoplastics and ionomer resins having particular refractive indexes.

BACKGROUND OF THE INVENTION

Golf balls, whether of solid or wound construction, generally include a core and a cover. It is known in the art to modify the properties of a conventional solid ball by altering the typical single layer core and single cover layer construction to provide a ball having at least one mantle layer disposed between the cover and the core. The core may be solid or liquid-filled, and may be formed of a single layer or one or more layers. Covers, in addition to cores, may also be formed of one or more layers. These multi-layer cores and covers are sometimes known as "dual core" and "dual cover" golf balls, respectively. Additionally, many golf balls contain one or more intermediate layers that can be of solid construction or, in many cases, be formed of a tensioned elastomeric winding, which are referred to as wound balls. The difference in play characteristics resulting from these different types of constructions can be quite significant. The playing characteristics of multi-layer balls, such as spin and compression, can be tailored by varying the properties of one or more of these intermediate and/or cover layers.

Manufacturers make use of a variety of materials to provide the golf ball with a durable cover, including ionomer resins, such as Surlyn produced by E.I. DuPont de Nemours and Co. of Wilmington, Del. or IOTEK® produced by Exxon Corporation of Houston, Tex., and softer cover materials, such as polyurethane. To enhance visibility of the golf ball or to impart aesthetically pleasing characteristics to golf balls, a number of prior art golf balls have been introduced that comprise a layer of paint over the cover to provide a colored or reflective ball. It is well-known in the art that balls comprising a paint layer often experience chipping or scuffing, resulting in a marred surface.

Other prior art balls incorporate dyes, pigments, or other particulates into the cover material to achieve a ball with a visually appealing cover. For instance, U.S. Pat. No. 5,427,378 discloses a golf ball having a cover comprising a resin wherein light reflective particles are admixed therein. In commonly-owned U.S. Pat. No. 6,949,595, which is incorporated herein by reference in its entirety, the cover comprises colorless polyurethane and an amount of fluorescent dye. U.S. Patent Application Publication No. 2008/0015053 teaches a golf ball comprising a colored core and a translucent cover comprising an interference pigment. The interference pigment preferably provides the cover with a pearlescent look and may comprise such materials as metal oxide-coated micas, basic lead carbonate, bismuth oxychloride or natural pearl. While the incorporation of pigments, dyes and other particulates into the material of the cover or sub-layers provides a more wear-resistant aesthetic effect, pigments and other particulates often collect and orient themselves in the seams and parting lines of the cover during molding. This creates a displeasing visual effect, as the homogenous look of the cover is interrupted by concentrations of particulates, dyes or pigments at the seams or parting lines.

There exists a need in the art for a golf ball having a cover that provides a unique visual effect but that remains wear-resistant during normal play. There also exists a need in the art for a golf ball having a cover that provides a unique look without the displeasing aesthetic effect of the orientation of particulates, dyes and pigments at seams and parting lines.

SUMMARY OF THE INVENTION

The present invention is directed to a golf ball comprising at least a core and a cover, wherein the cover comprises a first thermoplastic, a second thermoplastic, and a compatibilizer comprising reactive functional moieties chosen from the group consisting of hydroxyl, cyano, anhydride, epoxy, acid, and amine, wherein the first thermoplastic has an index of refraction that differs from an index of refraction of the second thermoplastic by at least about 0.5 percent, and wherein the cover has a pearlescent appearance.

The present invention is also directed to a method of obscuring the parting line of a golf ball comprising the steps of:

(a) providing a first thermoplastic, a second thermoplastic having an index of refraction that differs from an index of refraction of the first thermoplastic by at least 0.5 percent, and a compatibilizer comprising reactive functional moieties chosen from the group consisting of hydroxyl, cyano, anhydride, epoxy, acid, and amine;

(b) mixing the first thermoplastic, the second thermoplastic, and the compatibilizer to form a cover material; and (c) forming a golf ball cover out of the cover material.

DETAILED DESCRIPTION

The present invention is directed to a golf ball having at least a core and a cover. More particularly, the present invention is directed to a golf ball having a cover comprising a blend of ionomer resins and thermoplastics which provides a unique visual effect, particularly by manipulating the indices of refraction of the cover materials. The present invention is also directed to a golf ball wherein a pearlescent effect obscures any visible seam or parting line.

A preferred embodiment of the present invention is a golf ball comprising a center, a cover, and at least one intermediate layer disposed between the center and the cover. Generally, the cover has a thickness of at least 0.01 inch, has at least one of a material hardness of less than about 70 Shore D, a flexural modulus of less than about 75 kpsi, and a dimple coverage of greater than about 65% and the ball has an Atti compression of less than about 120. More particularly, the material hardness may range from about 45 to about 70 Shore D, and more preferably from about 55 to about 65 Shore D. The flexural modulus may range from about 30 to about 75 kpsi, more preferably from about 45 to about 70 kpsi, and most preferably from about 50 to about 65 kpsi.

The cover is formed from at least two thermoplastics having different indices of refraction. The two thermoplastics' refractive indices differ by between about 0.5 percent and about 6 percent. Preferably, the cover also comprises a compatibilizer to improve the impact strength and resiliency of the cover.

A refractive index, n, of a material is a measure of the phase velocity, v, of light passing through the material, as compared to the phase velocity, c, of light in a vacuum. Specifically, $n=c/v$. Thus, in a material having a refractive index of 1.25, light would travel at $0.8*c$. It should be noted that the phase velocity v can be dependent on the wavelength of the light. With respect to polymers, the refractive index n is not uniform throughout the polymer, and can vary based on orientation, conformation and phase change. As a result, the refractive index reported from polymers is generally an averaged value based on the differences in internal structure throughout each molecule. These averaged results generally vary from about 1.3 to 1.7. Refractive indices for various polymers are listed by James C. Seferis in "Refractive Indices of Polymers," Polymer Handbook, Third Edition, J. Brandrup and E. H. Immergut, Eds., VI, 451 (1989), which is incorporated herein by reference in its entirety.

Closely associated with the concept of refractive index is the concept of refraction. As light passes from a material having a first refractive index into a material having a second refractive index, at an angle to the boundary between the first and second materials, the light will be deflected based on the different refractive indices of the two materials. This relationship is generally covered by Snell's Law. Snell's Law states that that the ratio of the sines of the angles of incidence and refraction is equivalent to the ratio of velocities in the two materials, or equivalent to the opposite ratio of the indices of refraction. Formulaically: $\sin(\theta_1)/\sin(\theta_2)=v_1/v_2=n_2/n_1$, or alternatively, $n_1*\sin(\theta_1)=n_2*\sin(\theta_2)$. This means that when light travels from a material having a lower refractive index into a material having a higher refractive index, the light will be deflected toward a line normal to the boundary between the materials.

Refraction has significant effects on the visual properties of objects in the context of multi-colored light. Because the phase velocity v can vary based on wavelength, and c is a constant, the refractive index n of materials can vary based on the wavelength of light in question. When refractive index n varies, the angle of refraction may also vary. Thus, the angle of refraction of light at a phase boundary can vary based on the wavelength of the incoming light. Where light composed of multiple wavelengths passes through a phase boundary, the different wavelengths thus can be deflected different amounts, leading to dispersion of the light. This dispersion leads to the light splitting effects of a prism, for example.

The inventors have discovered that this dispersion has a significant effect on the visual properties of mixtures of polymers. Without being restricted to any particular theory, the inventors believe that when two or more polymers having different indices of refraction are mixed, incident light continually encounters boundaries between areas of mixture having different indices of refraction. Because incident light generally comprises light having a variety of wavelengths, and the index of refraction of each material varies based on the phase velocity of the light, and hence, the light's wavelength, the amount of refraction experienced by the light at each of these boundaries varies based on the wavelength of the light, and different wavelengths of light are refracted different amounts. This results in a microscale prismatic effect. As this microscale prismatic effect is duplicated at each intervening boundary where the index of refraction changes, the end result is chaotic light scattering which results in the mixture having a macroscale pearlescent appearance. A pearlescent effect created in this manner will avoid the various prior art attempts to provide unique appearance to golf balls, because it is not subject to the presence of pigments, dyes, or additives which attempt to create a pearlescent effect, and thus avoids the accumulation and orientation of such pigments, dyes, or additives around seams or parting lines, and thus avoids emphasizing the parting line. Additionally, the pearlescent effect of has a tendency to obscure the seam or parting line, by breaking up the visual continuity of the ball. This makes the parting line even less apparent than it otherwise would be.

Depending on the polymers in a mixture and their refractive indices, the prismatic effect can be more or less apparent. The inventors have found that a difference in refractive indices of at least 0.5 percent and not more than 6 percent is preferred. More preferably, the difference in refractive indices between the polymers is between 2 percent and 4 percent. Polymers having these degrees of difference between their respective refractive indices will display the unique pearlescent effect desired for a golf ball.

In addition to having a unique appearance, however, a golf ball cover must also be sufficiently resilient to withstand repeated strikes with a golf club. This requires that it be formed of materials with sufficient compatibility between the polymers and sufficient resiliency such that it allows the production of a golf ball having a high coefficient of restitution which is not brittle or otherwise prone to breakage. The inventors have found that mixtures of polymers having different indices of refraction often do not meet these requirements, and are prone to brittleness such that they can shatter when hit with a golf club, because the materials are sufficiently dissimilar that the interactions between the two different materials is insufficient.

In order to overcome this deficiency, the inventors have introduced an additional suitable compatibilizer into the material mixture in order to improve the properties of the mixture. This compatibilizer allows the mixture to obtain the desired pearlescent visual effect while also allowing the formation of a cover material that is sufficiently impact resistant to be used in a golf ball. Structurally, the preferred compatibilizers are polymers or copolymers having reactive functional groups. These functional groups are generally polar and allow strong chemical interactions such as dipole-dipole or ion-dipole or ion-ion or hydrogen bonding or a chemical bond between the compatibilizer and polar thermoplastics. Other portions of the compatibilizers are generally non-polar and form stronger bonds with other non-polar or less polar thermoplastics. This variation in the bonding of different parts of the compatibilizers allows the compatibilizers to overcome the insufficient bonding in the mixture absent the compatibilizers.

Thus, the cover comprises a first thermoplastic having a certain index of refraction, a second thermoplastic having a different index of refraction, and a compatibilizer.

The first thermoplastic is preferably an ionomeric material, such as ionic copolymers of ethylene and an unsaturated monocarboxylic acid, which are available under the trademark SURLYN® of E.I. DuPont de Nemours & Co., of Wilmington, Del., or IOTEK® or ESCORT of Exxon. These are copolymers or terpolymers of ethylene and methacrylic acid or acrylic acid that are totally, highly, or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The first thermoplastic may also include at least one ionomer, such as acid-containing ethylene copolymer ionomers, including E/X/Y terpolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer.

The acid-containing ethylene copolymer ionomers may additionally comprise aliphatic, mono-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending). These polymers containing α,β-unsaturated carboxylic acid groups that have been neutralized by organic fatty acids or their salts are referenced as highly-neutralized polymers ("HNPs").

The acid moieties of the HNPs, typically ethylene-based ionomers, are preferably neutralized greater than about 70 percent, more preferably greater than about 90 percent, and most preferably at least about 100 percent. The HNPs may be also be blended with a second polymer component, which, if containing an acid group, may be neutralized in a conventional manner in the presence of a suitable cation source in the presence of organic fatty acids and their salts. The second polymer component, which may be partially, highly, or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like.

The ionomer also may include so-called "low acid" and "high acid" ionomers, as well as blends thereof. In general, ionic copolymers including up to about 16 percent acid are considered "low acid" ionomers, while those including greater than about 16 percent acid are considered "high acid" ionomers.

A low acid ionomer is believed to impart high spin. Thus, in one embodiment, the first thermoplastic includes a low acid ionomer where the acid is present in about 10 to 16 weight percent and optionally includes a softening comonomer, e.g., iso- or n-butylacrylate, to produce a softer terpolymer. The softening comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

In another embodiment, the first thermoplastic includes at least one high acid ionomer, for low spin rate and maximum distance. In this aspect, the acrylic or methacrylic acid is present in about 15 to about 35 weight percent, making the ionomer a high modulus ionomer. In one embodiment, the high modulus ionomer includes about 16 percent by weight of a carboxylic acid, preferably from about 17 percent to about 25 percent by weight of a carboxylic acid, more preferably from about 18.5 percent to about 21.5 percent by weight of a carboxylic acid. In some circumstances, an additional comonomer such as an acrylate ester (i.e., iso- or n-butylacrylate, etc.) can also be included to produce a softer terpolymer. The additional comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high modulus ionomers include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, and the like.

Other common thermoplastic polymer components, such as copolyetheresters, copolyesteresters, copolyetheramides, elastomeric polyolefins, styrene diene block copolymers and their hydrogenated derivatives, copolyesteramides, thermoplastic polyurethanes, such as copolyetherurethanes, copolyesterurethanes, copolyureaurethanes, epoxy-based polyurethanes, polycaprolactone-based polyurethanes, polyureas, and polycarbonate-based polyurethanes fillers, and other ingredients, if included, can be blended in either before, during, or after the acid moieties are neutralized.

Examples of these materials are disclosed in U.S. Patent Application Publication Nos. 2001/0018375 and 2001/0019971, which are incorporated herein in their entirety by express reference thereto.

The ionomer components of the first thermoplastic may also include at least one grafted metallocene catalyzed polymers. Blends of this embodiment may include about 1 part per hundred (phr) to about 100 phr of at least one grafted metallocene catalyzed polymer and about 99 phr to 0 phr of at least one ionomer, preferably from about 5 phr to about 90 phr of at least one grafted metallocene catalyzed polymer and about 95 phr to about 10 phr of at least one ionomer, more preferably from about 10 phr to about 75 phr of at least one grafted metallocene catalyzed polymer and about 90 phr to about 25 phr of at least one ionomer, and most preferably from about 10 phr to about 50 phr of at least one grafted metallocene catalyzed polymer and about 90 phr to about 50 phr of at least one ionomer.

The ionomer is preferably a copolymer of ethylene and acrylic or methacrylic acid. The acrylic or methacrylic acid is preferably partially, highly, or fully neutralized using a suitable cation source such as lithium, sodium, zinc or potassium, more preferably lithium, sodium, or zinc and their blends. The first thermoplastic can also be a blend of a lithium ionomer and a sodium ionomer. Suitable lithium neutralized ionomers are marketed as Surlyn® 7930 and 7940 by E.I. du Pont de Nemours and Co. of Wilmington, Del. Suitable sodium neutralized ionomers are marketed as Surlyn® 8940 and 8945. Suitable zinc neutralized ionomers are marketed as Surlyn® 9910 and 9945. Preferably, the ionomer is a blend of Surlyn 7940 or 8940 and Surlyn 8945, 9910, or 9945. Preferably, the first thermoplastic has an index of refraction between 1.45 and 1.55.

The second thermoplastic is preferably either a styrene-butadiene copolymer (SBC) or a blend of polycarbonate and acrylonitrile-butadiene-styrene terpolymer (PC/ABS), or a combination of SBC and PC/ABS or a blend of acrylonitrile-butadiene-styrene terpolymer and a styrene-butadiene copolymer (SBC) (ABS/SBC). Preferably, the second thermoplastic comprises between 10 percent and 20 percent by weight SBC. A suitable styrene-butadiene copolymer is marketed as K-Resin® SBC by Chevron Phillips Chemical Company LLC of The Woodlands, Tex. Preferably the SBC is K-Resin KR03. Preferably, the second thermoplastic has an index of refraction between 0.5 percent and 6 percent higher than the first thermoplastic. More preferably, the second thermoplastic has an index of refraction between 2 percent and 4 percent higher than the first thermoplastic.

The compatibilizer is a polymer having reactive functional moieties such as hydroxyl, cyano, anhydride, epoxy, acid, or amine. Preferably, the compatibilizer comprises maleic anhydride grafted olefin copolymers, such as ethylene-propylene, butene, hexene, or octene, marketed as Fusabond® by E.I. du Pont de Nemours and Co., ethylene-acrylic ester-maleic anhydride terpolymers, such as those marketed as Lotader® MAH by Arkema® Inc. of Philadelphia, Pa., ethylene-methyl acrylate-glycidyl methacrylate terpolymers such as those marketed as Lotader® GMA by Arkema® Inc., hydroxy or maleic anhydride terminated polybutadienes, such as those marketed as Krasol®, Ricon® and Poly BD® by Sartomer® Company Inc. of Exton, Pa., or maleic anhydride grafted styrene-ethylene-butylene-styrene copolymers, such as those marketed as Kraton FG 1901X® by Kraton Polymers LLC of Houston, Tex. More preferably, the compatibilizer comprises Poly BD 2035 and Fusabond 525D. Alternatively, the compatibilizer may be Lotader MAH 2210, 3210, 4210, 3410, 3430, 6200, 8200, 3300, TX8030, 9309, or 9305 or Lotader GMA AX8840, AX8900, AX8920 or AX8930.

The inventive cover composition generally comprises between about 50 percent and about 85 percent, more preferably between about 60 percent and about 80 percent, and most preferably about 70 percent of the first thermoplastic. The cover composition generally comprises between about 10 percent and about 45 percent, more preferably between about 15 percent and about 35 percent, and most preferably about 25 percent of the second thermoplastic. The cover composition generally comprises between about 1 percent and about 10 percent, more preferably between about 3 percent and about 7 percent, and most preferably about 5 percent compatibilizer.

The cover of the golf ball of the present invention may have a thickness between about 0.010 and about 0.100 inches. More preferably, the cover has a thickness between about 0.020 and about 0.080 inches. Most preferably, the cover has a thickness from about 0.025, or about 0.030, to about 0.050 inches. Additionally, the golf ball preferably has a coefficient of restitution of at least about 0.700 at 125 ft/sec incoming velocity and an Atti compression less than about 120, such as between about 50 and about 120 or, more preferably, between about 90 and about 105. An optional intermediate layer may have a thickness between about 0.010 and about 0.060 inches, or a thickness between about 0.015 to 0.060 inches. More preferably, the intermediate layer has a thickness between about 0.020 and about 0.055 inches. Most preferably, the intermediate layer has a thickness between about 0.030 and about 0.050 inches. The core of the golf ball of the present invention may have a diameter between about 0.50 and about 1.620 inches. More preferably, the core has a thickness between about 0.80 and about 1.610 inches. Most preferably, the core has a thickness between about 1.000 and about 1.600 inches.

In one particular embodiment, the golf ball may comprise a center having an outer diameter from about 0.5 inches to about 1.3 inches, an intermediate layer having a thickness from about 0.015 to about 0.06 inches, and an outer cover layer having a thickness from about 0.025 inches to 0.05 inches.

The core and intermediate layer can be made from any thermoset or thermoplastic polymers known to one of ordinary skill in the art. Suitable thermoset and thermoplastic polymers are described in co-owned, co-pending U.S. patent application Ser. No. 11/707,493, filed on Feb. 16, 2007, and U.S. Patent Application Publication No. 2004/0176188, published on Sep. 9, 2004, which are both incorporated herein by reference in their entireties. Preferably, the core or the intermediate layer does not have a dark color that could "bleed" through the cover to affect the overall color of the ball.

In addition to the previously referenced components, the cover may additionally include other additives or modifiers, including, but not limited to, melt flow modifiers, density adjusting fillers, whitening agents, UV stabilizers, optical brighteners, and the like.

An optional, filler component may be chosen to adjust the density of the blends described herein, but care should be taken to make sure the optical properties remain as desired. The selection of such filler(s) is dependent upon the type of golf ball desired (i.e., one-piece, two-piece multi-component, or wound), and any filler available to one of ordinary skill in the art is suitable for use according to the invention. Examples of useful fillers include zinc oxide ("ZnO"), barium sulfate, calcium oxide, calcium carbonate, and silica, as well as any salts and oxides thereof. Additional fillers, such as foaming agents, glass and/or plastic microspheres, and various metals, can be added to the polyurethane or polyurea compositions of the present invention, in amounts as needed, for their well-known purposes.

A clear coat may also optionally be applied over the cover layer.

In one embodiment, the pearlescent cover comprises a plurality of dimples on its surface as well as surface off-sets other than dimples. The surface off-sets may be artifacts from the casting or molding of the cover. For example, during injection molding, a golf ball core or precursor is placed within a molding cavity comprising two hemispheres. The core or precursor is supported by pins so that it maintains its position in the center of the golf ball. Molten cover material is then injected into the molding cavity through apertures or gates and surrounds the core or precursor to harden and form the cover. As the molten cover material envelops the core or precursor, the supporting pins retract, allowing the molten material to fill in the cavities created by the pins. The retraction of the pins often causes the formation of "witness lines" on the cover about the area where the pins meet the mold. Likewise, during compression molding of a cover, a parting line may form along the equator of the golf ball. In accordance with the present invention, the witness lines created on the cover by the injection molding process or the parting line resulting from compression molding may be removed by post-mold finishing processes such as vibration tumbling, and may be further obscured by the pearlescent effect of the cover.

Cores of the present invention are enclosed with a cover, which may be a single-, dual-, or multi-layer cover. The golf ball core may be a hollow, a liquid filled or wound core known in the golf ball art.

Additional materials suitable for forming the core layers include the core compositions disclosed in U.S. Pat. No. 7,300,364, the entire disclosure of which is hereby incorporated herein by reference. For example, suitable center and outer core materials include HNPs neutralized with organic fatty acids and salts thereof, metal cations, or a combination of both. In addition to HNPs neutralized with organic fatty acids and salts thereof, core compositions may comprise at least one rubber material having a resilience index of at least about 40. Preferably the resilience index is at least about 50. Polymers that produce resilient golf balls and, therefore, are suitable for the present invention, include but are not limited to CB23, CB22, commercially available from of Bayer Corp. of Orange, Tex., BR60, commercially available from Enichem of Italy, and 1207G, commercially available from Goodyear Corp. of Akron, Ohio. Additionally, the unvulcanized rubber, such as polybutadiene, in golf balls prepared according to the invention typically has a Mooney viscosity of between about 40 and about 80, more preferably, between about 45 and about 65, and most preferably, between about 45 and about 55. Mooney viscosity is typically measured according to ASTM-D 1646.

In addition to the above materials, the center can be formed from a low deformation material selected from metal, rigid plastics, polymers reinforced with high strength organic or inorganic fillers or fibers, and blends and composites thereof. Suitable low deformation materials also include those disclosed in U.S. Pat. No. 7,004,856, the entire disclosure of which is hereby incorporated herein by reference.

While it is apparent that the illustrative embodiments of the invention disclosed herein fulfill the objectives stated above, it is appreciated that numerous modifications and other embodiments may be devised by those skilled in the art. It will be understood that the appended claims are intended to cover all such modifications and embodiments, which would come within the spirit and scope of the present invention.

What is claimed is:

1. A golf ball comprising:

at least a core and a cover, wherein the cover comprises a first thermoplastic, a second thermoplastic, and a compatibilizer comprising reactive functional moieties chosen from the group consisting of hydroxyl, cyano, anhydride, epoxy, acid, and amine, wherein the first thermoplastic has an index of refraction that differs from an index of refraction of the second thermoplastic by at least about 0.5 percent, and wherein the cover has a pearlescent appearance, and wherein the second thermoplastic comprises a copolymer consisting of styrene and butadiene.

2. The golf ball of claim 1, wherein the index of refraction of the first thermoplastic differs from the index of refraction of the second thermoplastic by not more than about 6 percent.

3. The golf ball of claim 2, wherein the index of refraction of the first thermoplastic differs from the index of refraction of the second thermoplastic by at least about 2 percent and not more than about 4 percent.

4. The golf ball of claim 1, wherein the index of refraction of the first thermoplastic is between about 1.45 and about 1.55.

5. The golf ball of claim 1, wherein the first thermoplastic comprises an ionomer.

6. The golf ball of claim 5, wherein the first thermoplastic comprises a copolymer of ethylene and either acrylic or methacrylic acid.

7. The golf ball of claim 6 wherein the acrylic or methacrylic acid is at least partially neutralized.

8. The golf ball of claim 6 wherein the acrylic or methacrylic acid is highly neutralized.

9. The golf ball of claim 1, wherein the copolymer of styrene and butadiene comprises between about 10 percent and about 20 percent of the second thermoplastic.

10. The golf ball of claim 1, wherein the cover comprises between about 50 percent and about 85 percent of the first thermoplastic.

11. The golf ball of claim 10, wherein the cover comprises between about 60 percent and about 80 percent of the first thermoplastic.

12. The golf ball of claim 10, wherein the cover comprises about 70 percent of the first thermoplastic.

13. The golf ball of claim 1, wherein the cover comprises between about 10 percent and about 45 percent of the second thermoplastic.

14. The golf ball of claim 13, wherein the cover comprises between about 15 percent and about 35 percent of the second thermoplastic.

15. The golf ball of claim 1, wherein the cover comprises between about 1 percent and about 10 percent of the compatibilizer.

16. The golf ball of claim 15, wherein the cover comprises between about 3 percent and about 7 percent of the compatibilizer.

17. The golf ball of claim 1, wherein the cover has a material hardness from about 45 to about 70 Shore D.

18. The golf ball of claim 1, wherein the cover has a material hardness from about 55 to about 65 Shore D.

19. The golf ball of claim 1, wherein the cover has a flexural modulus from about 30 to about 75 kpsi.

20. The golf ball of claim 1, wherein the cover has a flexural modulus from about 45 to about 70 kpsi.

21. The golf ball of claim 1, wherein the cover has a flexural modulus from about 50 to about 65 kpsi.

22. The golf ball of claim 1, wherein the golf ball has an Atti compression of less than about 120.

23. The golf ball of claim 1, wherein the golf balls has an Atti compression from about 90 to about 105.

24. The golf ball of claim 1, wherein the golf ball has a coefficient of restitution of at least 0.700.

25. The golf ball of claim 1 further comprising an intermediate layer disposed between the core and the cover.

26. The golf ball of claim 25, wherein the core has an outer diameter between about 0.5 and about 1.62 inches and the core comprises a center having an outer diameter from about 0.5 inches to about 1.3 inches, wherein the intermediate layer has a thickness from about 0.015 to about 0.06 inches, and wherein the outer cover layer has a thickness from about 0.025 inches to about 0.05 inches.

27. A golf ball comprising:

at least a core and a cover, wherein the cover comprises a first thermoplastic a second thermoplastic, and a compatibilizer comprising reactive functional moieties chosen from the group consisting of hydroxyl, cyano, anhydride, epoxy, acid, and amine, wherein the first thermoplastic has an index of refraction that differs from an index of refraction of the second thermoplastic by at least about 0.5 percent, and wherein the cover has a pearlescent appearance, wherein the second thermoplastic comprises a blend of polycarbonate and a terpolymer of acrylonitrile, butadiene, and styrene.

28. A method of obscuring the parting line of a golf ball comprising the steps of:

(a) providing a first thermoplastic, a second thermoplastic having an index of refraction that differs from an index of refraction of the first thermoplastic by at least 0.5 percent, and a compatibilizer comprising reactive functional moieties chosen from the group consisting of hydroxyl, cyano, anhydride, epoxy, acid, and amine, wherein the second thermoplastic comprises a copolymer consisting of styrene and butadiene;

(b) mixing the first thermoplastic, the second thermoplastic, and the compatibilizer to form a cover material; and (c) forming a golf ball cover out of the cover material.

29. The method of claim 28, wherein the index of refraction of the second thermoplastic is different from the index of refraction of the first thermoplastic by not more than 6 percent.

* * * * *